US005201075A

United States Patent [19]

Svetich

[11] Patent Number: 5,201,075

[45] Date of Patent: Apr. 13, 1993

[54] SEPARABLE VENTILATED ATHLETIC JACKET

[76] Inventor: Ronald J. Svetich, 1137 Timber La., Ft. Collins, Colo. 80521

[21] Appl. No.: 940,477

[22] Filed: Sep. 4, 1992

[51] Int. Cl.[5] ..... A41D 1/02

[52] U.S. Cl. ..... 2/108; 2/16; 2/85; 2/126; 2/93; 2/115; 2/DIG. 1

[58] Field of Search ..... 2/108, 106, 93, DIG. 1, 2/16, 46, 51, 85, 86, 126, 115

[56] References Cited

U.S. PATENT DOCUMENTS

| | | | |
|---|---|---|---|
| 308,244 | 11/1884 | Fishel | 2/DIG. 1 |
| 1,424,215 | 8/1922 | Rowe | 2/59 |
| 1,796,782 | 3/1931 | Gasperini | 2/59 |
| 1,833,109 | 11/1931 | Day . | |
| 2,114,514 | 4/1938 | York . | |
| 2,295,741 | 9/1942 | Kessler . | |
| 3,837,007 | 9/1974 | Girest . | |
| 4,006,495 | 2/1977 | Jones . | |
| 4,229,833 | 10/1980 | Cox . | |
| 4,356,570 | 11/1982 | Vernon et al. | 2/16 |
| 4,608,715 | 9/1986 | Miller . | |
| 4,722,099 | 2/1988 | Kratz | 2/DIG. 1 |
| 4,985,934 | 1/1991 | Perry | 2/59 |
| 4,996,723 | 3/1991 | Huhn et al. | 2/DIG. 1 |
| 4,998,654 | 3/1991 | Bruzak . | |
| 4,999,850 | 3/1991 | Grilliot . | |
| 5,035,001 | 7/1991 | Novick | 2/59 |

*Primary Examiner*—Clifford D. Crowder
*Assistant Examiner*—Gloria Hale
*Attorney, Agent, or Firm*—Dean P. Edmundson

[57] ABSTRACT

Athlete's arm jacket which includes a first shell portion for covering one side of the upper torso of a person wearing the jacket. A sleeve is secured to the shell portion for covering one arm. A mesh covers the opposite side of the upper torso, and a second shell portion is detachably secured to the first shell portion. Another sleeve is attached to the second shell portion. The jacket may be worn and used as a traditional jacket, or one shell portion may be detached so that only one arm, shoulder and one side of the upper torso of the body are covered.

12 Claims, 3 Drawing Sheets

SEPARABLE VENTILATED ATHLETIC JACKET

FIELD OF THE INVENTION

This invention relates to outerwear. More particularly, this invention relates to jackets. Even more particularly, this invention relates to jackets and other articles of clothing worn by athletes primarily to protect and warm their elbow, shoulder, shoulder blade and pectoral muscles, shoulder joints and tendons while at rest.

BACKGROUND OF THE INVENTION

Many athletes (for example, baseball and softball pitchers) have a need to keep their elbow, shoulder, shoulder blade and pectorial muscles, joints and tendons warm and ready for action. Also, a quarterback in football, the tennis player, horseshoe thrower, etc. face the same need to keep a portion of their upper body warm while at rest so that they are able to perform to the best of their ability on very short notice.

In order to maintain a portion of the upper body warm while at rest, an athlete typically has worn a bulky, hot, and cumbersome full jacket, even if only a portion of their upper torso needs to be covered. For example, a right handed thrower would be covering his/her right elbow, shoulder, shoulder blade and pectoral areas, so the left side would not need to be covered. The reverse is also true for a left handed thrower. Pitchers are often seen sitting in a dug-out, bull-pen, or running the bases, with a full jacket on, or one that is worn with a sleeve on one arm while allowing the other half of the jacket to hang precariously at their side. The unprofessional appearance of wearing a jacket in this fashion is due to the athlete's need to keep those vital areas covered and warm, while not covering the other areas of the upper torso which do not need to be kept warm. The hanging garment creates a sloppy, unprofessional appearance, along with interfering with other activities. Additionally, the excess material may get caught on protruding objects which can lead to serious injury. For these reasons, many athletes choose not to wear any protective garment at all, which then increases the chances for stiff and tight muscles.

Another existing problem is that an athlete's elbow and shoulder muscles are more susceptible to injury than other parts of the upper torso. In the construction of a traditional warm-up/athletic jacket, there is nothing that addresses this important issue. Simply covering the injured areas with a jacket is helpful but does nothing to alleviate the problem.

Also, if athletes wear a full jacket to keep one side of their torso warm, and the weather is conducive to a lighter garment, they risk overheating which in turn could contribute to heat exhaustion, or even heat stroke. On the other hand, if athletes decide not to wear any protective garment, they risk stiffness and possible injury of their vital muscles, tendons, ligaments and joints when asked to perform. In the past, the problem of an elbow or shoulder injury has been dealt with by going into the training room and receiving a therapeutic treatment in the form of a hot or cold pack that is applied to the injured area. The problem with this is the inconvenience of missing the remainder of the game, along with the time it takes to get set up in the training room for the treatment. It would be more convenient for all concerned to have immediate treatment while still being able to sit in the dug out with other teammates.

In the past there have been proposed various types of sleeves or similar coverings to be worn on a single arm. However, such articles have not been entirely acceptable for various reasons.

In U.S. Pat. No. 4,985,934 (Perry) there is described a sports sleeve to be worn by a sports player. It covers one arm and a portion of the upper torso of the person. Straps are used to retain the sleeve on the body. The construction of the garment is such that it does not keep the entire upper half of the torso warm because the garment is cut high on the bottom in front and back and does not include any means for securing the bottom of the garment close to the body. As a result, body heat may escape through draft holes which can lead to excess heat loss, causing stiffness and tightening of the muscles. In turn, this can cause injury, thereby defeating its purpose. Furthermore, because the sports sleeve covers only a portion of the person's body, if the weather turns cold, the individual would need to additionally wear a full conventional jacket over the sleeve. This would restrict movement because of the bulky garments. To alleviate this problem, one would need to take off the sleeve and wear just the full conventional jacket. However, in so doing, the sports sleeve would serve no purpose.

Another problem with the sports sleeve is that if the person becomes involved in vigorous activities (such as sprinting, sliding, or swinging a bat) the sports sleeve would move about the upper torso because of the straps sliding out of position, which could cause bodily movement to be restricted.

Furthermore, there is a substantial risk that the straps could become caught on objects, thereby causing injury. Yet another problem is that the straps may have a tendency to become entwined when not in use. The need to have the straps untangled and carefully positioned around the body before they can be fastened may require the assistance of another person just to put on and secure the sports sleeve.

Yet another problem with the sports sleeve is that it is not cosmetically acceptable. It is very important to maintain cosmetic harmony among the clothing of team players. It is also important to have garments which can be worn off the field in public.

U.S. Pat. No. 4,229,833 (Cox) also describes a warm-up sleeve to be worn by an athlete. The sleeve includes a portion for covering the arm and the top of the shoulder. A strap is used to retain the sleeve in place. The strap extends around the upper torso. The sleeve does not cover any portion of the torso. The warm-up sleeve allows body heat to escape. This may lead to excess heat loss, causing stiff and tight muscles. This could result in injury, thereby defeating the purpose of the sleeve. The warm-up sleeve also suffers from many of the same problems as the sports sleeve of Perry.

U.S. Pat. No. 4,356,570 (Vernon) also describes a warm-up sleeve which is very similar to the sleeve described by Cox, although it appears to cover additional shoulder area and it avoids the need for straps by using fasteners such as Velcro patches. This type of warm-up sleeve would suffer from the same disadvantages described above with respect to the Cox warm-up sleeve.

U.S. Pat. No. 1,796,782 (Gasperini) describes a garment protector for automobile drivers. The protector includes one sleeve and a strap or fastener for attaching the protector to a coat or around the neck. The protector is used by a driver to protect his or her clothes from getting wet in rainy weather when extending the left arm out of the window to signal turns. This protector would not be useful for warming one arm and shoulder of an athlete. It exhibits many of the disadvantages of the sleeves described by the patents mentioned above, and it was not intended for use by athletes.

U.S. Pat. No. 4,608,715 (Miller et al.) describes a protective garment in the form of a jacket having zippers on the front and back panels to permit opening of slits to allow air to pass through the garment for ventilation purposes. The garment is intended for use by riders of bicycles, motorcycles, etc. where the person is traveling at relatively high speed. Openable slits are used to allow ventilation without billowing the garment in the wind. The protective garment would be cumbersome for an athlete to wear in that it would restrict or impede a person's upper body movement while engaging in athletic activity. Also, the restricted ventilation system in the garment would not be adequate to allow an athlete's body to cool down appropriately.

U.S. Pat. No. 4,999,850 (Grilliot et al.) describes a firefighter's garment having an outer shell layer, a moisture barrier layer and a thermal barrier layer. The garment has a vest section and detachable sleeve sections. Each section is releasably attached within a bunker coat and can be separately detached from the bunker coat. The garment is not designed or intended for use by an athlete. It also is not useful for warming one arm and shoulder of a person. In order to warm one arm it is still necessary to wear the vest or the bunker coat in order to hold the sleeve in place. Thus, such garment would not be suitable for an athlete.

U.S. Pat. No. 3,837,007 (Girest) describes a shirt or jacket having reflectorized sleeves for use by a traffic officer. Alternatively, a pair of reflectorized sleeves can be worn which are attached to each other at their upper ends by a strap. The sleeves are intended to be worn over both arms at the same time. Such sleeves are not intended for warming one arm and shoulder of an athlete and would not be suitable for such purpose.

U.S. Pat. No. 4,006,495 (Jones) describes a coat construction having semi-detachable sleeves. The coat includes pockets for receiving the sleeves in their semi-detached condition. This coat is not suitable for use by an athlete because it requires that the main or torso portion of the coat be worn in order to support even one sleeve. This could result in over-heating of the athlete. Such coat construction would be cumbersome for an athlete to wear also.

U.S. Pat. No. 1,833,109 (Day) describes a garment for use by an automobile driver to protect against rain, sleet and snow. It is similar in design and construction to the protective garment described by Gaspernini, above. It would not be suitable for use by athletes.

U.S. Pat. No. 4,998,654 (Bruzek et al.) describes a carrier vest for carrying packages and articles. The vest includes two carrier bags formed within the vest walls. Such vest does not include any arm coverings and would not be suitable for use by an athlete who needs to warm one arm and shoulder.

U.S. Pat. No. 2,114,514 (York) describes an airflow garment in the form of a sport jacket having ventilating seams through the back and sides. Such sport jacket does not include any provision for warming only one arm of the wearer, and consequently the sport jacket would not be suitable for use by an athlete.

U.S. Pat. No. 2,295,741 (Kessler) describes a long garment lining having detachable sleeves. Such garment is not intended for use in warming only one arm and shoulder. Therefore, such garment would not be suitable for use by an athlete.

There has not heretofore been provided a jacket construction which is especially suitable for use by an athlete who needs to keep one arm, shoulder area, and upper torso warm while at rest.

SUMMARY OF THE PRESENT INVENTION

In accordance with the present invention there is provided an athlete's jacket which is especially adapted to warm one arm, shoulder, shoulder blade, and pectoral areas of the body without unduly restricting normal movement of the body. The jacket includes a torso surrounding portion and two sleeves. One of the sleeves is detachable along with the shoulder covering and a portion of the torso portion for one side of the body. Yet, the jacket can be used as a normal or conventional jacket garment, when desired, when the detachable sleeve portion is attached to the jacket.

The jacket may be constructed so that either the right or the left sleeve and shoulder portion may be detached, as desired. Team emblems may be displayed on the front along with the person's name and number for instant identification. A pocket may be included for carrying personal items.

Preferably the jacket includes interior pockets adjacent the elbow and shoulder regions for inserting a hot or cold pack to therapeutically treat over-exerted joints, muscles, tendons and ligaments. The contents within such pockets can be secured therein by means of Velcro fasteners (hook and loop fasteners) to ensure that the therapeutic effects of the hot and cold packs are produced at the desired areas. Because the packs are contained within the jacket, the wearer can receive treatment without anyone noticing. The external appearance of the jacket is not changed when the packs are in place.

The jacket may be insulated or non-insulated. The jacket can be worn as a normal jacket so as to maintain cosmetic harmony with other team members.

Thus, with the jacket construction of this invention, the vital areas of the shoulder, arm, back, and one side of the upper torso are protected, while the other side of the upper torso is covered with a mesh or highly porous material for excellent ventilation. The jacket is light in weight and is not cumbersome. It enables the wearer to maintain one arm, shoulder, and upper torso warm without interfering with physical activity.

The outer sleeve shell of one side of the jacket is easily detached. This reveals the light-weight mesh that is sleeveless, which helps prevent the side of the torso that is not being extensively used from being overheated while at the same time allowing the other half of the torso (where the vital areas have been worked extensively) to be protected and kept warm by a standard jacket covering. The sleeveless style mesh portion of the jacket totally eliminates the problem and inconvenience that is experienced when the athlete wears a full jacket; that is, there is no need to go without a protective garment for fear of overheating, or to hang half of the jacket at one side in an unsafe, unprofessional looking manner. In addition, if an athlete requires immediate therapeutic treatment for a sore elbow or shoulder, they can do so by simply placing a hot or cold pack into the pockets which have been provided on the inside of the garment over the elbow and shoulder regions. This allows an athlete the opportunity to remain in the dugout with teammates while simultaneously receiving immediate treatment. If an athlete desires therapeutic treatment for a sore elbow or shoulder, or if a light-weight, professional looking garment is desired, the jacket of this invention is very advantageous and useful.

Other advantages of the jacket of this invention will be apparent from the following detailed description.

BRIEF DESCRIPTION OF THE DRAWINGS

The invention is described in more detail hereinafter with reference to the accompanying drawings, wherein like reference characters refer to the same parts throughout the several views and in which.

DETAILED DESCRIPTION OF THE INVENTION

Figure 1:
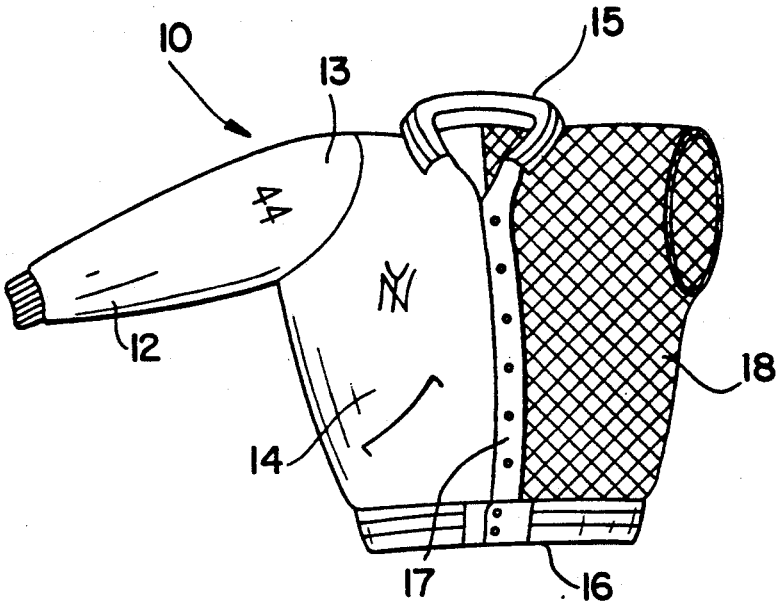
FIG. 1 is a front elevational view of one embodiment of jacket construction of this invention, with one sleeve, shoulder, and torso area detached.
Figure 2:
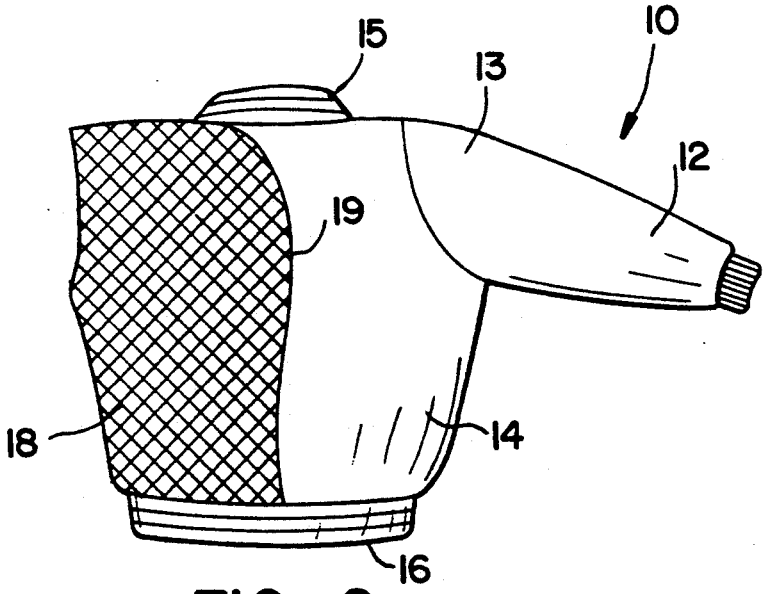
FIG. 2 is a rear elevational view of the embodiment of jacket of FIG. 1.

The athlete's arm jacket of this invention is shown and illustrated in the drawings. The jacket 10 includes one side which has one normal sleeve 12, shoulder 13, and torso 14 covering portions. The jacket also includes a normal collar portion 15, waist encircling band portion 16 and front vertical closure seam 17.

The other side of the jacket includes a mesh torso covering portion 18 which is secured at its lower edge to the waist encircling portion 16 and is secured at one side to the vertical closure seam 17. It is secured on the rear side to vertical seam 19. The mesh may be referred to as port-hole mesh, poly fishnet mesh or nylon mesh. It is very open and porous so as to allow air to freely pass through it.

Figure 3:
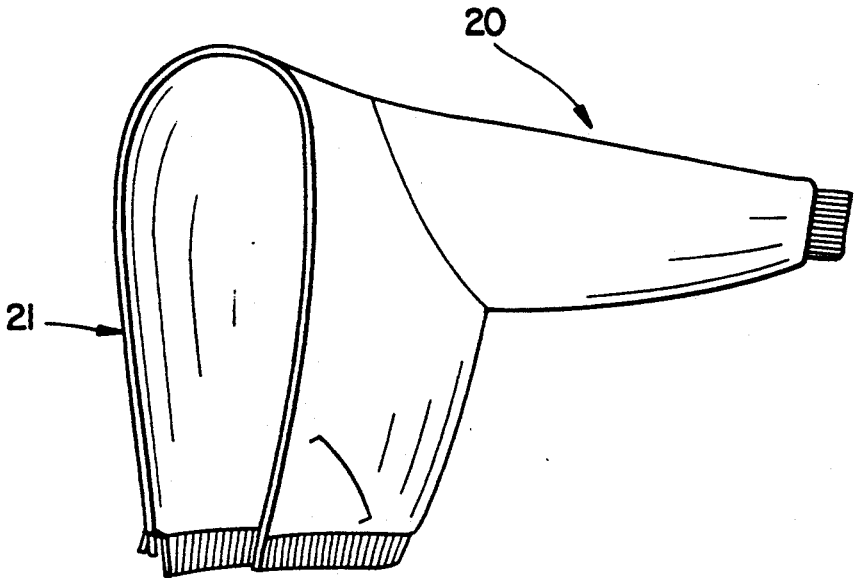
FIG. 3 is a front elevational view of the detached sleeve, shoulder and torso portion of the jacket.
Figure 4:
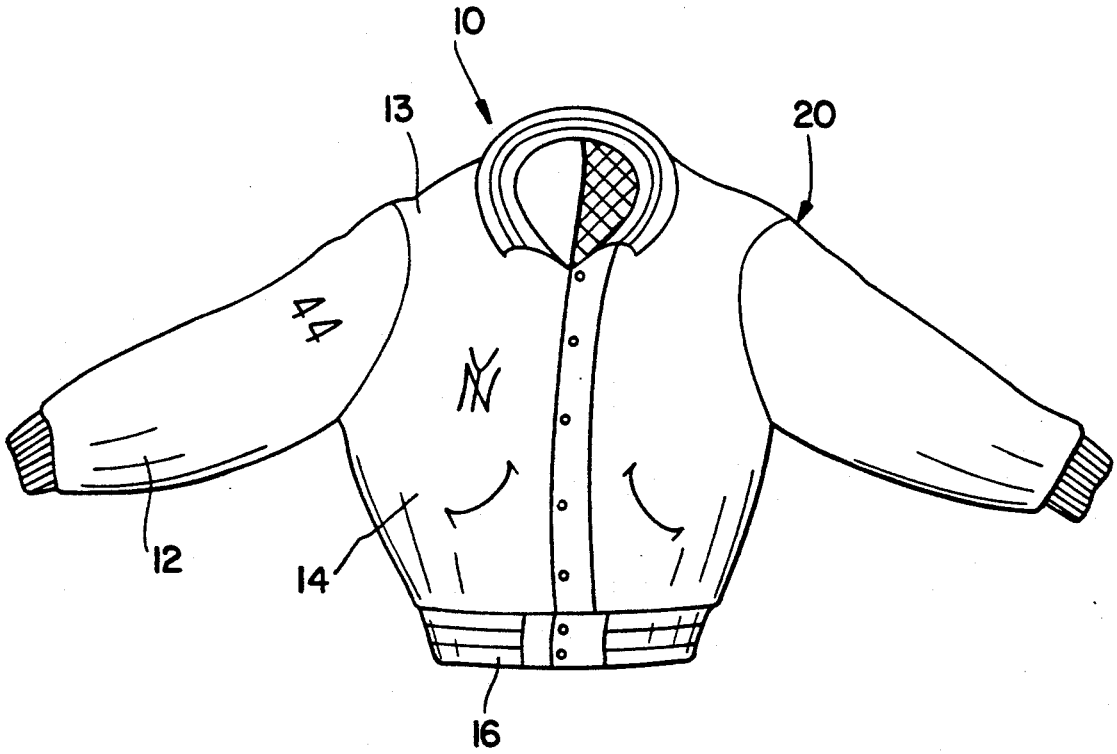
FIG. 4 is a front elevational view of the jacket with the detachable sleeve attached to the main portion of the jacket.
Figure 5:
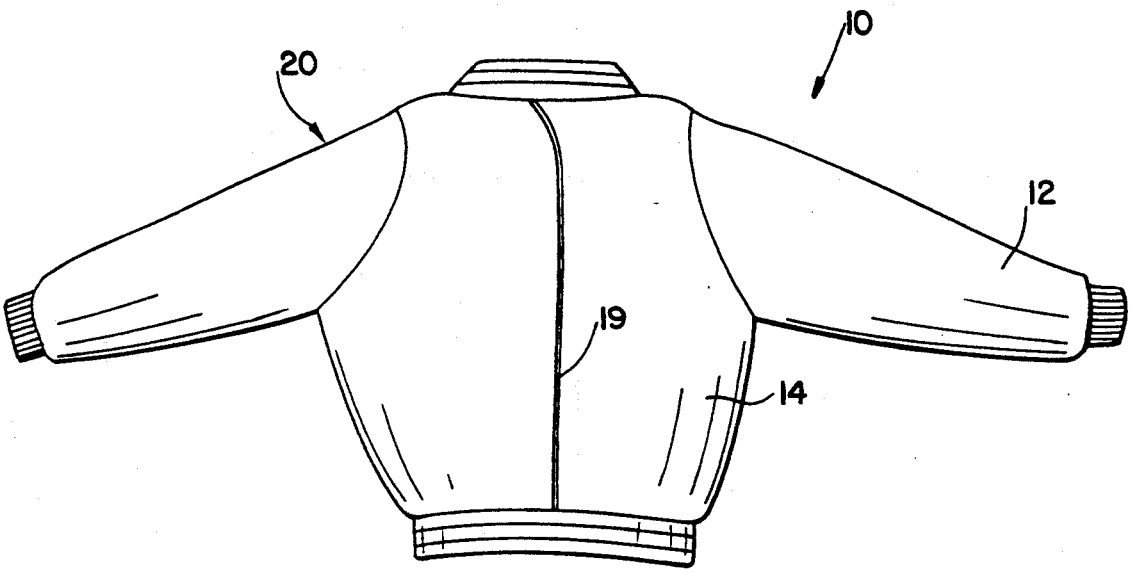
FIG. 5 is a rear elevational view of the jacket shown in FIG. 4.
Figure 6:
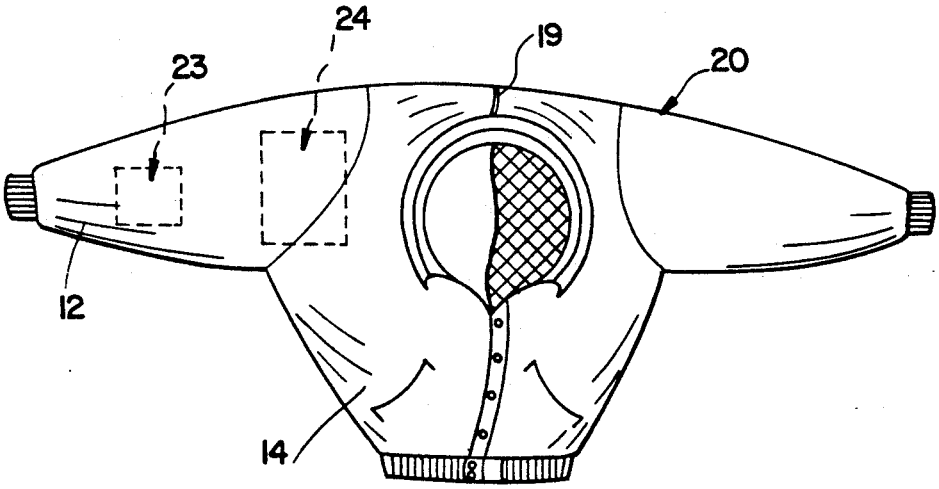
FIG. 6 is a top view of the jacket of FIG. 4 showing interior pockets in the elbow and shoulder areas.

When it is desired to wear the jacket as a normal jacket with both sleeves in place, the detachable sleeve section 20 (shown in FIG. 3) is simply and conveniently attached to the jacket. For example, a zipper 21 extending along the inside edge of the sleeve section is convenient for attaching the sleeve 20 to the jacket. As illustrated, the inside edge of the sleeve 20 mates with the vertical seam 19 on the rear of the jacket and it mates with the edge of the vertical seam 17 on the front of the jacket. The continuous zipper 21 on sleeve 20 mates with a complementary or mating zipper portion on seam 19 and also on vertical seam 17. The zipper also extends around the collar or neck portion.

Thus, the detachable sleeve section 20 can be removed from the jacket when it is necessary to warm only the opposite arm, shoulder, and upper torso. The waist encircling portion or band 16 and the mesh torso covering portion 18 are integral parts of the jacket. The front closure seam 17 is also an integral part of the jacket. The closure seam may include conventional snaps, buttons, or zipper closure means for closing the jacket around the body. The mesh portion 18 enables one side of the torso to gradually cool, which prevents possible heat exhaustion and muscle cramping.

The jacket and the detachable sleeve may be insulated or non-insulated, as desired. The jacket may also include an interior pocket, if desired, for carrying personal items.

The jacket preferably includes an interior pocket 23 adjacent the elbow portion and another interior pocket 24 adjacent the shoulder portion for the purpose of inserting hot or cold packs, as needed, for appropriate therapeutic treatment of the elbow and shoulder of the athlete, these being vital areas which are prone to soreness, stiffness, or injury due to extensive use.

The outer shell of the jacket may be composed of any desired material (e.g., nylon). Of course, the jacket could be constructed so as to enable the right or the left side to be detached, as desired for a particular person. The jacket can also be constructed so as to fit any size person.

Thus, the jacket of this invention enables vital areas of the arm, shoulder and upper torso to be covered while allowing the opposite arm, shoulder, and upper torso to be uncovered. Then, when it is desired to cover both arms and shoulders, the detachable sleeve can be attached to the jacket, whereupon the jacket can be worn as a normal jacket with a normal appearance.

Other variants are possible without departing from the scope of this invention. For example, the detachable sleeve can be attached to the jacket in a variety of manners (e.g., hook and loop fasteners, snaps, buttons, etc.). The preferred manner of attaching the sleeve to the jacket is by means of a light-weight nylon zipper. Such a zipper does not allow any openings in the seam area. Consequently, when the sleeve is attached, cold air cannot enter the jacket through the seam. This is very important because when the sleeve is attached to the jacket, the jacket is intended to be worn as a traditional full jacket in which no ventilation is desired.

What is claimed is:

1. Athlete's arm jacket comprising:

(a) a first shell portion for covering one side of the upper torso of a person wearing the jacket;

(b) a first sleeve member attached to and carried by said first shell portion;

(c) a mesh material attached to said first shell portion for covering the opposite side of the upper torso of said person;

(d) closure means for closing said jacket around the upper torso of said person;

(e) a second shell portion detachably secured to said first shell portion for covering said mesh material; and (f) a second sleeve member attached to and carried by said second shell portion.

2. A jacket in accordance with claim 1, wherein said second shell portion and said first shell portion are detachably connected together means of zipper means.

3. A jacket in accordance with claim 1, further comprising a waist-encircling portion attached to said first shell portion and said mesh material.

4. A jacket in accordance with claim 1, further comprising a collar portion secured to said first shell portion and said mesh material.

5. A jacket in accordance with claim 3, further comprising zipper means extending vertically from said waist-encircling portion adjacent said closure means.

6. A jacket in accordance with claim 1, wherein said first sleeve member includes a first interior pocket.

7. A jacket in accordance with claim 6, wherein said first sleeve member includes two interior pockets.

8. Athlete's arm jacket comprising:

(a) a first shell portion for covering one side of the upper torso of a person wearing the jacket;

(b) a first sleeve member attached to and carried by said first shell portion;

(c) a mesh material attached to said first shell portion for covering the opposite side of the upper torso of said person;

(d) a waist-encircling portion attached to said first shell portion and said mesh material;

(e) a collar portion secured to said first shell portion and said mesh material;

(f) closure means for closing said jacket around the upper torso of said person;

(g) a second shell portion detachably secured to said first shell portion for covering said mesh material; and (h) a second sleeve member attached to and carried by said second shell portion.

9. A jacket in accordance with claim 8, wherein said second shell portion and said first shell portion are detachably connected together means of zipper means.

10. A jacket in accordance with claim 8, further comprising zipper means extending vertically from said waist-encircling portion adjacent said closure means.

11. A jacket in accordance with claim 8, wherein said first sleeve member includes a first interior pocket.

12. A jacket in accordance with claim 11, wherein said first sleeve member includes two interior pockets.

* * * * *